US011650610B2

(12) United States Patent
Guan et al.

(10) Patent No.: US 11,650,610 B2
(45) Date of Patent: May 16, 2023

(54) LOAD BALANCING ARCHITECTURE FOR GANGING VOLTAGE REGULATORS

(71) Applicant: QUALCOMM Incorporated, San Diego, CA (US)

(72) Inventors: Hua Guan, San Diego, CA (US); Fan Yang, Singapore (SG); Hardik Patel, San Diego, CA (US)

(73) Assignee: QUALCOMM Incorporated, San Diego, CA (US)

( * ) Notice: Subject to any disclaimer, the term of this patent is extended or adjusted under 35 U.S.C. 154(b) by 29 days.

(21) Appl. No.: 17/350,535

(22) Filed: Jun. 17, 2021

(65) Prior Publication Data

US 2022/0404850 A1 Dec. 22, 2022

(51) Int. Cl.
*G05F 1/563* (2006.01)
*G05F 1/59* (2006.01)

(52) U.S. Cl.
CPC ..... *G05F 1/563* (2013.01); *G05F 1/59* (2013.01)

(58) Field of Classification Search
CPC ..... G05F 1/563; G05F 1/59
See application file for complete search history.

(56) References Cited

U.S. PATENT DOCUMENTS

2009/0153108 A1 6/2009 Hendin et al.
2010/0164289 A1* 7/2010 Umminger ..... G05F 1/565 307/55
2018/0136680 A1 5/2018 Du et al.

FOREIGN PATENT DOCUMENTS

EP 3584668 A1 12/2019

OTHER PUBLICATIONS

Bulzacchelli J.F., et al., "Dual-Loop System of Distributed Microregulators With High DC Accuracy, Load Response Time Below 500 ps, and 85-mV Dropout Voltage," IEEE Journal Of Solid-State Circuits, vol. 47, No. 4, Apr. 2012, pp. 863-874.
International Search Report and Written Opinion—PCT/US2022/072474—ISA/EPO—dated Sep. 12, 2022.
Talele B., et al., "A Scalable and PCB-Friendly Daisy-Chain Approach to Parallelize LDO Regulators with 2.613% Durrent-Sharing Accuracy Using Dynamic Element Matching for Integrated Current Sensing", ISSCC 2020 / Session 32 / Power Management Techniques / 32.5, 2020 IEEE International Solid-State Circuits Conference, Feb. 19, 2020, 3 Pages.

* cited by examiner

*Primary Examiner* — Jue Zhang
(74) *Attorney, Agent, or Firm* — Patterson + Sheridan, L.L.P.

(57) ABSTRACT

Certain aspects of the present disclosure provide a power supply system. The power supply system generally includes a first voltage regulator and a second voltage regulator, outputs of the first voltage regulator and the second voltage regulator being coupled to an output of the power supply system. The power supply system may also include a current balancer circuit configured to adjust an output current of the first voltage regulator based on determined headrooms of the first voltage regulator and the second voltage regulator.

30 Claims, 5 Drawing Sheets

400

| LDO 2 | LDO 1 | HR Response | Current Balance Response |
|---|---|---|---|
| HR Too Low | HR Too Low | Increase HR | No action |
| | HR Too High | | |
| | HR Just Right | | |
| HR Too High | HR Too Low | Increase HR | No action |
| | HR Too High | Decrease HR | |
| | HR Just Right | No action | Decrease ΔVref |
| HR Just Right | HR Too Low | Increase HR | No action |
| | HR Too High | No action | Increase ΔVref |
| | HR Just Right | No action | No action |

FIG. 4

LOAD BALANCING ARCHITECTURE FOR GANGING VOLTAGE REGULATORS

TECHNICAL FIELD

Certain aspects of the present disclosure generally relate to electronic circuits and, more particularly, to a power supply circuit and regulation.

BACKGROUND

A voltage regulator ideally provides a constant direct current (DC) output voltage regardless of changes in load current or input voltage. Voltage regulators may be classified as either linear regulators or switching regulators. While linear regulators tend to be small and compact, many applications may benefit from the increased efficiency of a switching regulator. A linear regulator may be implemented by a low-dropout (LDO) regulator, for example. A switching regulator may be implemented by a switched-mode power supply (SMPS), such as a buck converter, a boost converter, or a buck-boost converter.

Power management integrated circuits (power management ICs or PMICs) are used for managing the power requirement of a host system and may include and/or control one or more voltage regulators (e.g., boost converters). A PMIC may be used in battery-operated devices, such as mobile phones, tablets, laptops, wearables, etc., to control the flow and direction of electrical power in the devices. The PMIC may perform a variety of functions for the device such as DC-to-DC conversion (e.g., using a voltage regulator as described above), battery charging, power-source selection, voltage scaling, power sequencing, etc. For example, a PMIC may feature a boost converter to boost a voltage level of a DC input voltage.

SUMMARY

Certain aspects of the present disclosure relate to a power supply system. The power supply system generally includes a first voltage regulator, a second voltage regulator, outputs of the first voltage regulator and the second voltage regulator being coupled to an output of the power supply system, and a current balancer circuit configured to adjust an output current of the first voltage regulator based on determined headrooms of the first voltage regulator and the second voltage regulator.

Certain aspects of the present disclosure relate to a method of supplying power. The method generally includes generating a first output current via a first voltage regulator, generating a second output current via a second voltage regulator, the first output current and the second output current being sourced to a common output node, and adjusting, via a current balancer circuit, the first output current based on determined headrooms of the first voltage regulator and the second voltage regulator.

Certain aspects of the present disclosure relate to an apparatus for supplying power. The apparatus generally includes means for generating a first output current, means for generating a second output current, the first output current and the second output current being sourced to a common output node, and means for adjusting the first output current based on determined headrooms associated with the means for generating the first output current and the means for generating the second output current.

To the accomplishment of the foregoing and related ends, the one or more aspects comprise the features hereinafter fully described and particularly pointed out in the claims. The following description and the appended drawings set forth in detail certain illustrative features of the one or more aspects. These features are indicative, however, of but a few of the various ways in which the principles of various aspects may be employed.

BRIEF DESCRIPTION OF THE DRAWINGS

So that the manner in which the above-recited features of the present disclosure can be understood in detail, a more particular description, briefly summarized above, may be had by reference to aspects, some of which are illustrated in the appended drawings. It is to be noted, however, that the appended drawings illustrate only certain typical aspects of this disclosure and are therefore not to be considered limiting of its scope, for the description may admit to other equally effective aspects.

FIG. 4 is a table illustrating example techniques for headroom (HR) adjustment and current balancing, in accordance with certain aspects of the present disclosure.

To facilitate understanding, identical reference numerals have been used, where possible, to designate identical elements that are common to the figures. It is contemplated that elements disclosed in one aspect may be beneficially utilized on other aspects without specific recitation.

DETAILED DESCRIPTION

Figure 1:
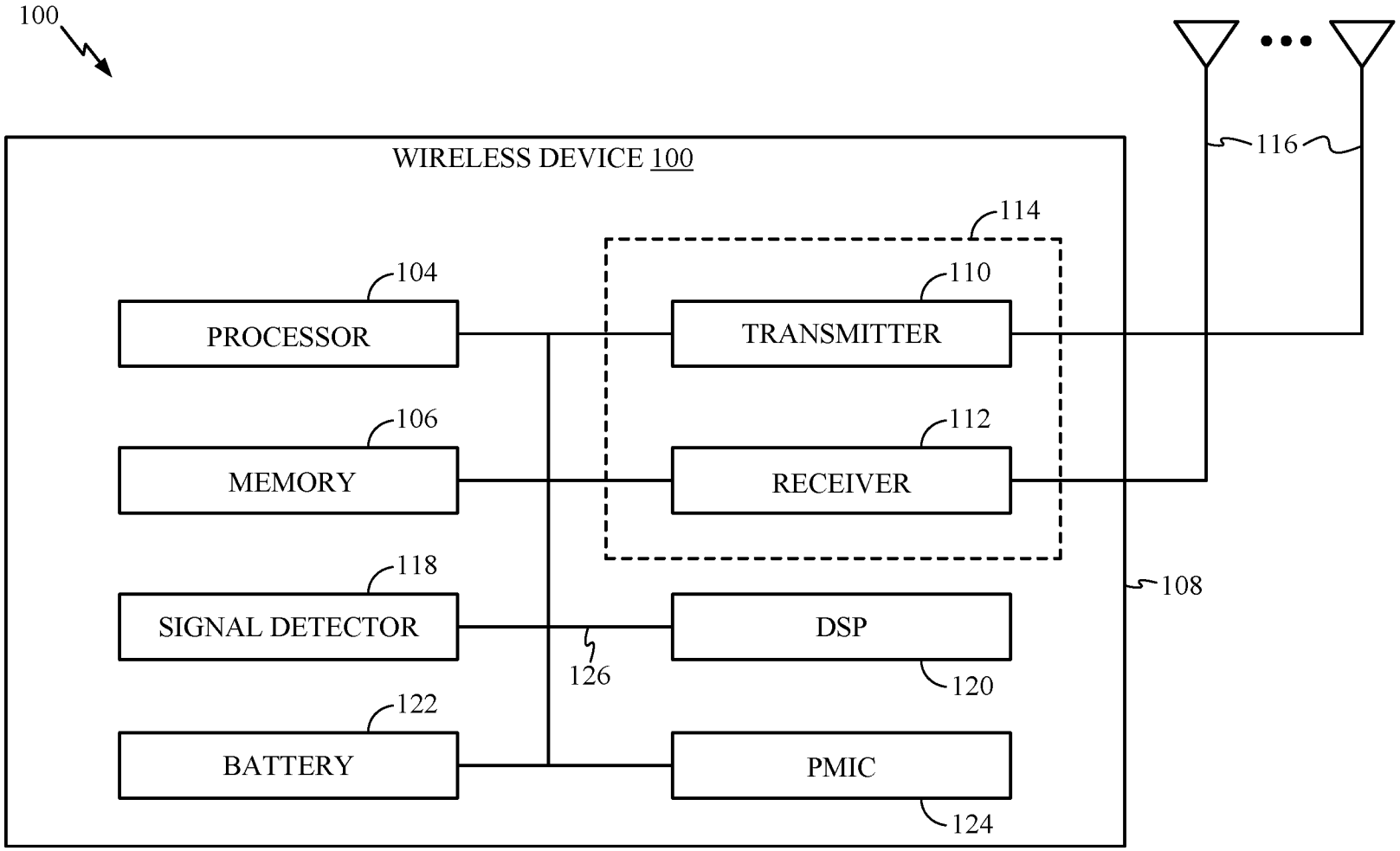
FIG. 1 is a block diagram of an example device including a voltage regulator, according to certain aspects of the present disclosure.

Certain aspects of the present disclosure are directed to apparatus and techniques for ganging of voltage regulators, such as low-dropout (LDO) regulators. For example, multiple LDO regulators may be used to source current to a common load. Some aspects of the present disclosure use determined headrooms of the LDO regulators to perform current balancing and headroom adjustment for the LDO regulators. For example, if any of the LDO regulators has a headroom that is too low, then the headrooms of (all) the LDO regulators may be increased. If the headrooms of all the LDO regulators are too high, then the headrooms for the LDO regulators may be decreased. If any of the LDO regulators has a headroom that is too high, while one or more other LDO regulators has a headroom that is acceptable, current balancing may be used to balance output currents of the LDO regulators, as described in more detail herein.

Various aspects of the disclosure are described more fully hereinafter with reference to the accompanying drawings. This disclosure may, however, be embodied in many different forms and should not be construed as limited to any specific structure or function presented throughout this disclosure. Rather, these aspects are provided so that this disclosure will be thorough and complete, and will fully convey the scope of the disclosure to those skilled in the art. Based on the teachings herein one skilled in the art should appreciate that the scope of the disclosure is intended to cover any aspect of the disclosure disclosed herein, whether implemented independently of or combined with any other aspect of the disclosure. For example, an apparatus may be implemented or a method may be practiced using any number of the aspects set forth herein. In addition, the scope of the disclosure is intended to cover such an apparatus or method which is practiced using other structure, functionality, or structure and functionality in addition to or other than the various aspects of the disclosure set forth herein. It should be understood that any aspect of the disclosure disclosed herein may be embodied by one or more elements of a claim.

The word "exemplary" is used herein to mean "serving as an example, instance, or illustration." Any aspect described herein as "exemplary" is not necessarily to be construed as preferred or advantageous over other aspects.

The techniques described herein may be used in combination with various wireless technologies such as Code Division Multiple Access (CDMA), Orthogonal Frequency Division Multiplexing (OFDM), Time Division Multiple Access (TDMA), Spatial Division Multiple Access (SDMA), Single Carrier Frequency Division Multiple Access (SC-FDMA), Time Division Synchronous Code Division Multiple Access (TD-SCDMA), and so on. Multiple user terminals can concurrently transmit/receive data via different (1) orthogonal code channels for CDMA, (2) time slots for TDMA, or (3) sub-bands for OFDM. A CDMA system may implement IS-2000, IS-95, IS-856, Wideband-CDMA (W-CDMA), or some other standards. An OFDM system may implement Institute of Electrical and Electronics Engineers (IEEE) 802.11, IEEE 802.16, Long Term Evolution (LTE) (e.g., in TDD and/or FDD modes), or some other standards. A TDMA system may implement Global System for Mobile Communications (GSM) or some other standards. These various standards are known in the art.

An Example Device

FIG. 1 illustrates a device 100. The device 100 may be a battery-operated device such as a cellular phone, a personal digital assistant (PDA), a handheld device, a wireless modem, a laptop computer, a tablet, a personal computer, etc. The device 100 is an example of a device that may be configured to implement the various systems and methods described herein.

The device 100 may include a processor 104 which controls operation of the device 100. The processor 104 may also be referred to as a central processing unit (CPU). Memory 106, which may include both read-only memory (ROM) and random access memory (RAM), provides instructions and data to the processor 104. A portion of the memory 106 may also include non-volatile random access memory (NVRAM). The processor 104 typically performs logical and arithmetic operations based on program instructions stored within the memory 106. The instructions in the memory 106 may be executable to implement the methods described herein.

The device 100 may also include a housing 108 that may include a transmitter 110 and a receiver 112 to allow transmission and reception of data between the device 100 and a remote location. The transmitter 110 and receiver 112 may be combined into a transceiver 114. A plurality of antennas 116 may be attached to the housing 108 and electrically coupled to the transceiver 114. The device 100 may also include (not shown) multiple transmitters, multiple receivers, and multiple transceivers.

The device 100 may also include a signal detector 118 that may be used in an effort to detect and quantify the level of signals received by the transceiver 114. The signal detector 118 may detect such signals as total energy, energy per subcarrier per symbol, power spectral density and other signals. The device 100 may also include a digital signal processor (DSP) 120 for use in processing signals.

The device 100 may further include a battery 122 used to power the various components of the device 100. The device 100 may also include a power management integrated circuit (power management IC or PMIC) 124 for managing the power from the battery to the various components of the device 100. The PMIC 124 may perform a variety of functions for the device such as DC-to-DC conversion, battery charging, power-source selection, voltage scaling, power sequencing, etc. In certain aspects, the PMIC 124 may include a voltage regulator system implemented by ganging of low-dropout (LDO) regulators.

The various components of the device 100 may be coupled together by a bus system 126, which may include a power bus, a control signal bus, and a status signal bus in addition to a data bus.

Example Voltage Regulation System

Certain aspects of the present disclosure generally relate to techniques for ganging regulators (e.g., low-dropout (LDO) regulators). Ganging of regulators allows for a power management integrated circuit (PMIC) (e.g., PMIC 124) to meet higher current demands. Ganging of regulators also provides more flexibility to repurpose existing PMICs for different chipsets. Configuring the regulators to operate within an acceptable headroom range (e.g., a desired headroom range for improving performance and lowering power consumption) may save system power and resolve thermal challenges. Some aspects of the present disclosure use current balancing with an aim to increase power efficiency associated with the ganging of the regulators. As used herein, the term "current balancing" may involve adjusting output currents of regulators to improve performance or increase power efficiency associated with the ganging of the regulators, even though the output currents may not be equal after such adjustment. Current balancing may be used when the headroom of an amplifier is too low resulting in the amplifier performance beginning to degrade. In some aspects, the headroom of each amplifier may be detected, and the detected headrooms may be used to adjust the current balancing of the regulator to increase power efficiency for the power supply system.

Figure 2:
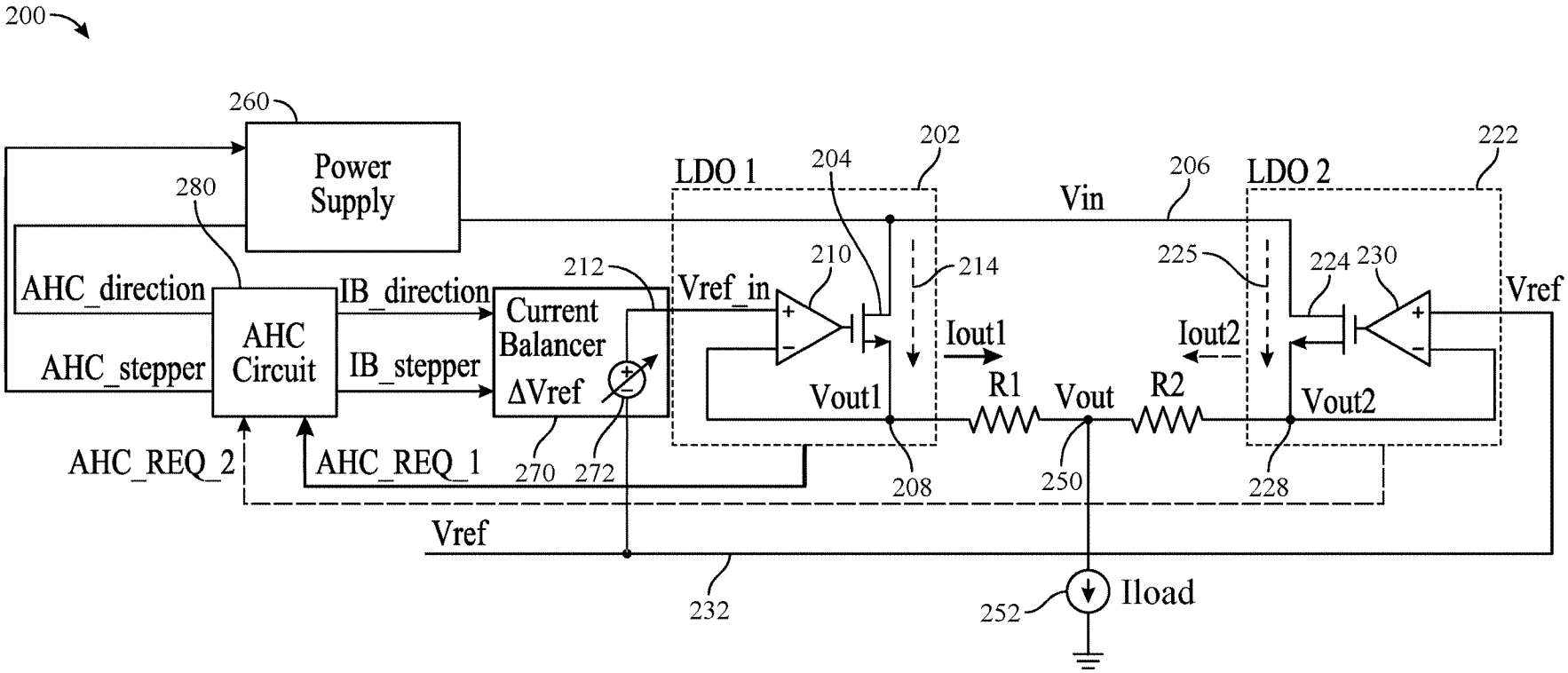
FIG. 2 illustrates a power supply system that uses ganging low-dropout (LDO) regulators, in accordance with certain aspects of the present disclosure.

FIG. 2 illustrates a power supply system 200 that uses ganging LDO regulators, in accordance with certain aspects of the present disclosure. As shown, the power supply system 200 may include multiple LDO regulators (e.g., LDO regulator 202 and LDO regulator 222) having outputs coupled to a load (e.g., represented by current source 252). For instance, LDO regulator 202 may include a transistor 204 (referred to as a "pass transistor") having a drain coupled to an input voltage (Vin) node 206, and a source coupled to an output voltage (Vout1) node 208. LDO regulator 202 also includes an amplifier 210 (e.g., an error amplifier) having a first input (e.g., positive input) coupled to an input reference voltage (Vref_in) node 212, and a second output (e.g., negative output) coupled to the Vout1 node 208. Vref_in at the Vref_in node 212 may be used to control output current (Iout1) 214 (e.g., drain-to-source current of transistor 204) of the LDO regulator 202, in effect regulating the voltage at the Vout1 node 208 (e.g., labeled "Vout1"). In other words, increasing Vref_in may result in an increase of Iout1 214 (e.g., through resistive element R1).

As shown, LDO regulator 222 may include a transistor 224 having a drain coupled to the Vin node 206, and a source coupled to an output voltage node 228 (labeled "Vout2"). LDO regulator 222 also includes an amplifier 230 having a first input (e.g., positive input) coupled to a common reference voltage (Vref) node 232, and a second input (e.g., negative input) coupled to the Vout2 node 228. Vref at the Vref node 232 may be used to control output current (Iout2) 225 (e.g., drain-to-source current of transistor 224) of the LDO regulator 222. In other words, increasing Vref may result in an increase of Iout2 225 (e.g., through resistive element R2). As shown, the Vout2 node 228 and the Vout1 node 208 are coupled to a common output node 250 (labeled "Vout") through respective resistive elements R1 and R2 (e.g., in some aspects, the resistances of resistive elements R1 and R2 may differ due to resistor tolerance and/or routing variations). The common output node 250 may be coupled to a load circuit, represented by current source 252 (labeled "Iload"). The difference between Vin (e.g., at Vin node 206) and Vout1 or Vout2 represents the headroom (HR) of the LDO regulator 202 or LDO regulator 222, respectively. HR associated with an LDO is described in more detail with respect to FIG. 3.

Figure 3:
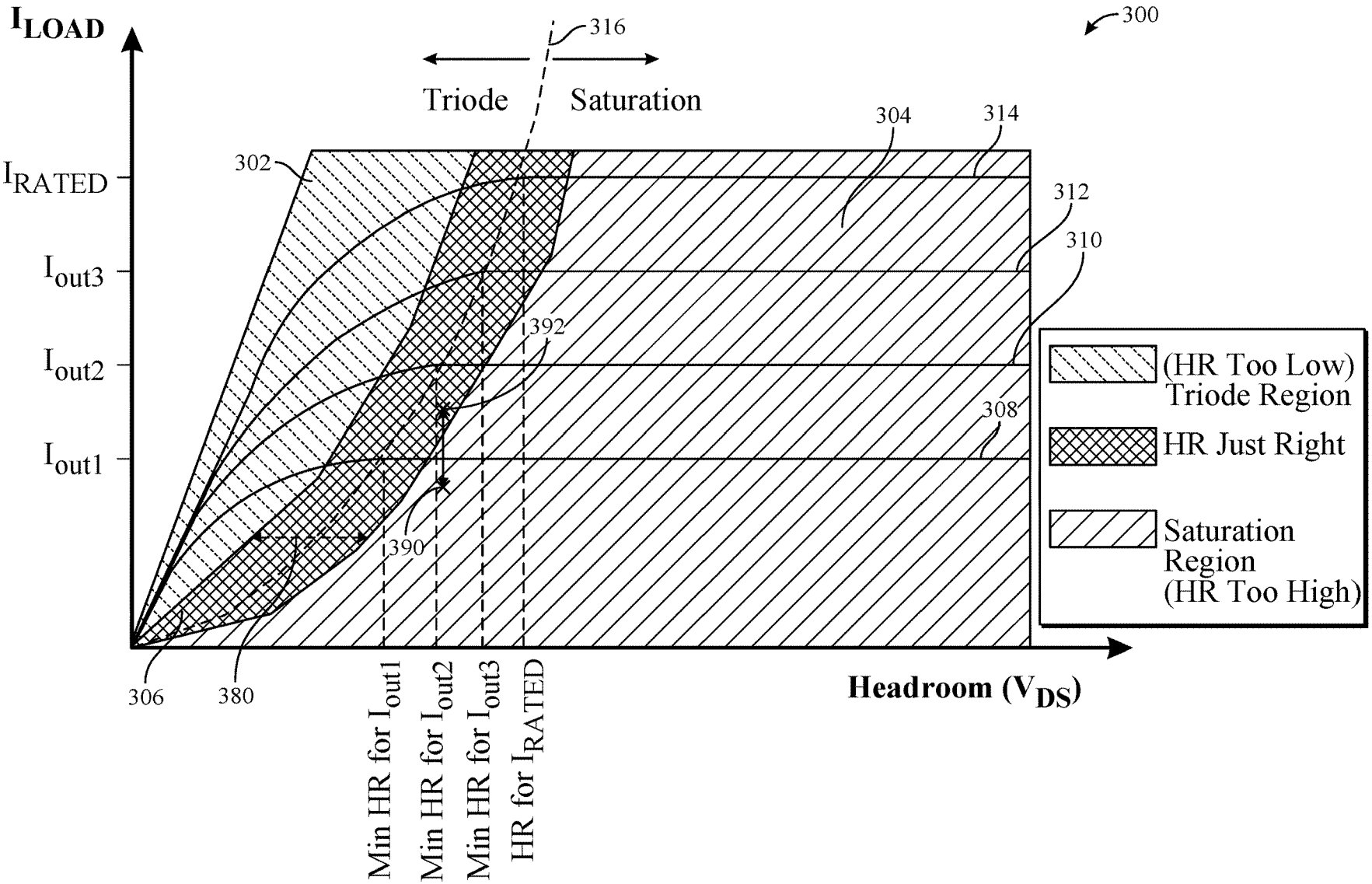
FIG. 3 is a graph various operating regions of an LDO regulator, in accordance with certain aspects of the present disclosure.

FIG. 3 is a graph 300 illustrating various operating regions of an LDO regulator, in accordance with certain aspects of the present disclosure. The operating regions described with respect to FIG. 3 may be associated with different HR and output current ranges for different LDO regulators, depending on the characteristics of the LDO regulators (e.g., characteristics of transistors used to implement the LDO regulators). As shown, an LDO regulator may operate within one of three regions of operation: the triode region 302, the saturation region 304, and an HR acceptable region 306 (also referred to as an "HR just right" region). As used herein, operating at an acceptable HR (e.g., operating in the HR acceptable region 306) generally refers to setting a HR for an LDO regulator that provides a better performance as compared to operating in the triode region and a better power efficiency as compared to operating in the saturation region. The HR acceptable region 306 may be a region following the curve 316, represented by equation:

$$HR = Irated \times \sqrt{\frac{Iout}{Irated}}$$

where Irated is the rated current (e.g., 100 mV) of the transistor (e.g., transistor 204 or transistor 224) of the LDO, Iout is the output current (e.g., Iout1 214 or Iout2 225) of the LDO regulator, and HR is the headroom of the LDO. As shown, there are different acceptable HRs (e.g., in HR acceptable region 306) depending on the Iout of the LDO regulator. For a specific output current of an LDO regulator, the HR acceptable region 306 may have a range (e.g., HR range 380) that may be set based on implementation and using a configured tolerance from the curve 316. The curves 308, 310, 312, 314 correspond to different gate-to-source voltages (Vgs) of the transistor of the LDO regulator (e.g., transistor 204 or 224).

In some aspects of the present disclosure, an LDO regulator may detect the HR of the LDO regulator. If HR is too low (e.g., the HR corresponds to operating in the triode region 302), the LDO regulator may be unable to source enough current and may request that the HR for the LDO regulator be increased. For example, referring back to FIG. 2, when the HR of the LDO regulator 202 is too low (e.g., the LDO regulator is operating in the triode region 302), LDO performance starts to roll off. The power supply system 200 may include a power supply 260 (e.g., a switched-mode power supply, such as a buck converter) that may generate and regulate Vin. When the HR of the LDO regulator 202 is too low, the power supply 260 may increase Vin, in effect increasing the HR of the LDO regulator 202 (e.g., as well as LDO regulator 222 since the Vin node 206 is common for both of the LDO regulators 202, 222).

If the HR of the LDO regulator is just right (e.g., the LDO regulator is operating in the HR acceptable region 306), the LDO may not request any change to the HR. If the HR of the LDO regulator is too high (e.g., the LDO regulator is operating in the saturation region 304), the LDO regulator may be configured to provide more current (e.g., decreasing the output of current to be sourced by other LDO regulators) until all LDOs report the same condition, and then request that the HR be decreased to save power, as described in more detail with respect to FIG. 4.

FIG. 4 is a table 400 illustrating example techniques for HR adjustment and current balancing, in accordance with certain aspects of the present disclosure. As shown, if any of the LDO regulators have too low HR (e.g., is operating in triode region 302), Vin may be increased to increase the HR of all LDO regulators. For example, as shown by table 400, if either LDO regulator 202 (also referred to as "LDO 1") or LDO regulator 222 (also referred to as "LDO 2") has a HR that is too low, the HR of both LDOs may be increased.

If all the LDO regulators have HRs that are too high (e.g., are operating in the saturation region 304), Vin may be decreased to decrease the HR of all LDO regulators. For example, as shown by table 400, if both LDO regulator 202 and LDO regulator 222 have HR that is too high, the HR of both LDOs may be decreased.

For other scenarios, such as the HR of one LDO regulator being too high, and the HR of another LDO regulator being just right, current balancing may be used. Referring back to FIG. 2, the power supply system 200 may include a current balancer 270. The current balancer 270 may include an adjustable voltage source 272 which may be controlled to set a voltage difference (ΔVref) between Vref and Vref_in. By increasing ΔVref (e.g., increasing the voltage offset associated with the adjustable voltage source 272), Iout1 214 may increase resulting in a decrease of Iout2 225. On the other hand, by decreasing ΔVref (e.g., decreasing the voltage associated with the adjustable voltage source 272), Iout1 214 may decrease resulting in an increase of Iout2 225. The current balancer 270 may be used to control the gate voltage of the transistor 204 of the LDO regulator 202 by applying voltage offset to Vref used to control the gate voltage of the transistor 224 of LDO regulator 222. Thus, the LDO regulator 202 may be referred to as a "slave LDO regulator," and the LDO regulator 222 may be referred to as a "master LDO regulator."

If a subset of the LDO regulators is in the HR acceptable region 306, and at least another one of the LDO regulators is in the saturation region 304, current balancing (e.g., via the current balancer 270) may be used to balance the current being sourced by the LDO regulators. For example, as shown by table 400, if LDO regulator 202 (LDO 1) has an HR that is too high (e.g., the LDO regulator 202 is operating in the saturation region 304), but LDO regulator 222 (LDO 2) has an HR that is acceptable (e.g., the LDO regulator 222 is operating in the HR acceptable region 306), the current balancer may increase ΔVref. As an example, if LDO regulator 202 (LDO 1) is operating at operating point 390 shown in FIG. 3, ΔVref may be increased, increasing Iout1 of LDO regulator 202 such that LDO regulator 202 is operating at operating point 392 (e.g., in the HR acceptable region 306). On the other hand, if LDO regulator 222 (LDO 2) has an HR that is too high (e.g., the LDO regulator 222 is operating in the saturation region), but LDO regulator 202 (LDO 1) has an HR that is acceptable (e.g., the LDO regulator 202 is operating in the acceptable HR region), the current balancer may decrease ΔVref.

In some aspects, power supply system 200 of FIG. 2 may include auto-headroom control (AHC) circuit 280. The LDO regulator 202 and LDO regulator 222 may provide AHC request signals (AHC_REQ_1 and AHC_REQ_2, respectively) to the AHC circuit 280. The AHC request signals may indicate whether each respective LDO regulator has a HR that is too high, too low, or acceptable. For example, each of the LDO regulator 202 and LDO regulator 222 may include circuitry that detects the HR of the LDO regulator (e.g., difference between Vin and Vout1 or difference between Vin and Vout2) and the output current of the LDO (e.g., Iout1 214 or Iout2 225). Based on the detected HR and Iout, each LDO regulator may determine and indicate whether the LDO regulator has an HR that is too high, too low, or acceptable as shown in graph 300. In some cases, each LDO regulator may provide more detailed information, such as the detected HR and Iout of the LDO, via the AHC request signals.

Based on the AHC request signals, the AHC circuit 280 may control the power supply 260 (e.g., for controlling HR by regulating Vin) and the current balancer 270 (e.g., for current balancing), in accordance with the techniques described with respect to FIG. 4. For instance, the AHC circuit may provide an AHC direction signal to the power supply indicating whether HR is to be increased or decreased, and an AHC stepper signal indicating a step size associated with the increase or decrease.

While only two LDO regulators are described to facilitate understanding, the aspects of the present disclosure may be implemented for any number of multiple LDO regulators. For example, if ganging of more than two LDO regulators is implemented, a current balancer may be implemented for all except one of the LDO regulators. For example, for three LDO regulators, if any of the three LDO regulators has an HR that is too low, then the HRs of all the LDO regulators may be increased. If the HRs of all three LDO regulators are too high, then the HRs for the LDO regulators may be decreased. If any of the LDO regulators has an HR that is too high, while one or more other LDO regulators has an HR that is acceptable, current balancing may be used to balance output currents of the LDO regulators, as described herein.

Certain aspects described herein may achieve higher power efficiency as compared to conventional implementations. The techniques described herein may be expandable to multiple LDOs across the PMIC and may be implemented for ganging of LDO regulators of different types.

Example Techniques for Supplying Power

Figure 5:
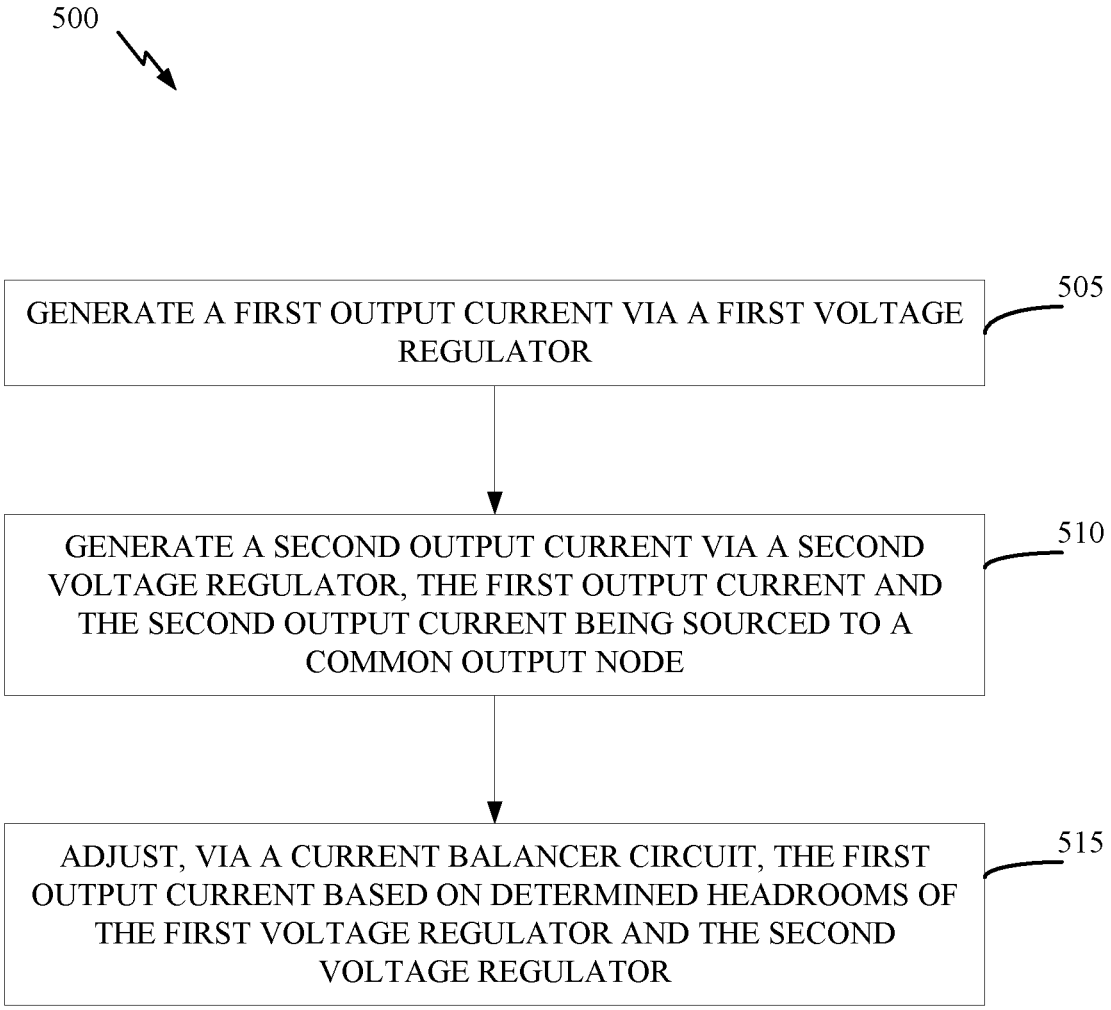
FIG. 5 is a flow diagram illustrating example operations for voltage regulation, in accordance with certain aspects of the present disclosure.

FIG. 5 is a flow diagram illustrating example operations 500 for supplying power, in accordance with certain aspects of the present disclosure. The operations 500 may be performed, for example, by the power supply system 200.

The operations 500 begin, at block 505, with the power supply system generating a first output current (e.g., Iout1 214) via a first voltage regulator (e.g., LDO regulator 202). At block 510, the power supply system generates a second output current (e.g., Iout2 214) via a second voltage regulator (e.g., LDO regulator 222), the first output current and the second output current being sourced to a common output node (e.g., common output node 250). At block 515, the power supply system adjusts, via a current balancer circuit (e.g., current balancer 270), the first output current based on determined headrooms of the first voltage regulator and the second voltage regulator.

In some aspects, the first voltage regulator may include a first transistor (e.g., transistor 204), the determined headroom of the first voltage regulator being a difference between a drain voltage (e.g., Vin) and a source voltage (e.g., Vout1) of the first transistor. The second voltage regulator may include a second transistor (e.g., transistor 224), the determined headroom of the second voltage regulator being a difference between a drain voltage (e.g., Vin) and a source voltage (e.g., Vout2) of the second transistor.

In some aspects, the power supply system may adjust, via the current balancer circuit, the first output current based on whether the determined headroom of the first voltage regulator is within a first headroom range (e.g., corresponding to an HR range in the HR acceptable region 306 for LDO regulator 202) and whether the determined headroom of the second voltage regulator is within a second headroom range (e.g., corresponding to an HR range in the HR acceptable region 306 for LDO regulator 222). An upper limit of the first headroom range or the second headroom range may be less than a lower limit of a third headroom range (e.g., an HR range in the saturation region 304) associated with the first voltage regulator or the second voltage regulator operating in saturation, respectively. A lower limit of the first headroom range or the second headroom range may be greater than an upper limit of a fourth headroom range (e.g., an HR range in the triode region 302) associated with the first voltage regulator or the second voltage regulator operating in triode, respectively. In some aspects, adjust the first output current may include decreasing the first output current based on the determined headroom of the second voltage regulator (e.g., LDO regulator 222) being higher than an upper limit of the second headroom range (e.g., HR range in the HR acceptable region 306 for LDO regulator 222) and the determined headroom of the first voltage regulator (e.g., LDO regulator 202) being lower than a lower limit of the first headroom range (e.g., HR range in the HR acceptable region 306 for LDO regulator 202). In some aspects, adjust the first output current may include increasing the first output current based on the determined headroom of the first voltage regulator (e.g., LDO regulator 202) being higher than an upper limit of the first headroom range (e.g., HR range in the HR acceptable region 306 for LDO regulator 202) and the determined headroom of the second voltage regulator being lower than a lower limit of the second headroom range (e.g., HR range in the HR acceptable region 306 for LDO regulator 222).

In some aspects, the power supply system may adjust, via a headroom adjustment circuit (e.g., AHC circuit 280), a headroom of the first voltage regulator and a headroom of the second voltage regulator based on at least one of the determined headrooms of the first voltage regulator and the second voltage regulator. In some aspects, adjusting the headrooms may include increasing the headrooms of the first voltage regulator and the second voltage regulator based on the determined headroom of at least one of the first voltage regulator or the second voltage regulator being lower than a headroom range (e.g., HR range in the HR acceptable region 306). In some aspects, adjusting the headrooms may include decreasing the headrooms of the first voltage regulator and the second voltage regulator based on the determined headrooms of the first voltage regulator and the second voltage regulator being higher than a headroom range (e.g., HR range in the HR acceptable region 306).

In some aspects, the power supply system may adjust, via a headroom adjustment circuit (e.g., power supply 260), headrooms of the first voltage regulator and the second voltage regulator. The power supply system may also receive, via an auto headroom control circuit (e.g. AHC circuit 280), indications (e.g., AHC request signals) of the determined headrooms of the first voltage regulator and the second voltage regulator, and control, via the auto headroom control circuit, the headroom adjustment circuit and the current balancer circuit based on the indications of the determined headrooms. In some aspects, the headroom adjustment circuit may include a power supply (e.g., power supply 260) configured to generate an input voltage (e.g., at Vin node 206) for the first voltage regulator and the second voltage regulator. In some aspects, adjusting the first output current may include adjusting an offset (e.g., corresponding to ΔVref) between a first reference voltage (e.g., Vref_in) for the first voltage regulator and a second reference voltage (e.g., Vref) for the second voltage regulator.

The various operations of methods described above may be performed by any suitable means capable of performing the corresponding functions. The means may include various hardware and/or software component(s) and/or module (s), including, but not limited to a circuit, an application-specific integrated circuit (ASIC), or processor. Generally, where there are operations illustrated in figures, those operations may have corresponding counterpart means-plus-function components with similar numbering.

For example, means for generating an output current may include an LDO regulator, such as the LDO regulator 202 or LDO regulator 222. Means for generating an output current may alternatively or additionally include a power source, such as a battery (e.g., battery 122), and one or more power supply circuits (e.g., power supply 260). Means for adjusting may include a current balancer circuit, such as the current balancer 212.

As used herein, the term "determining" encompasses a wide variety of actions. For example, "determining" may include calculating, computing, processing, deriving, investigating, looking up (e.g., looking up in a table, a database, or another data structure), ascertaining, and the like. Also, "determining" may include receiving (e.g., receiving information), accessing (e.g., accessing data in a memory), and the like. Also, "determining" may include resolving, selecting, choosing, establishing, and the like.

As used herein, a phrase referring to "at least one of" a list of items refers to any combination of those items, including single members. As an example, "at least one of: a, b, or c" is intended to cover: a, b, c, a-b, a-c, b-c, and a-b-c, as well as any combination with multiples of the same element (e.g., a-a, a-a-a, a-a-b, a-a-c, a-b-b, a-c-c, b-b, b-b-b, b-b-c, c-c, and c-c-c or any other ordering of a, b, and c).

The various illustrative logical blocks, modules and circuits described in connection with the present disclosure may be implemented or performed with a general purpose processor, a digital signal processor (DSP), an ASIC, a field programmable gate array (FPGA) or other programmable logic device (PLD), discrete gate or transistor logic, discrete hardware components, or any combination thereof designed to perform the functions described herein. A general-purpose processor may be a microprocessor, but in the alternative, the processor may be any commercially available processor, controller, microcontroller, or state machine. A processor may also be implemented as a combination of computing devices, e.g., a combination of a DSP and a microprocessor, a plurality of microprocessors, one or more microprocessors in conjunction with a DSP core, or any other such configuration.

The methods disclosed herein comprise one or more steps or actions for achieving the described method. The method steps and/or actions may be interchanged with one another without departing from the scope of the claims. In other words, unless a specific order of steps or actions is specified, the order and/or use of specific steps and/or actions may be modified without departing from the scope of the claims.

The functions described may be implemented in hardware, software, firmware, or any combination thereof. If implemented in hardware, an example hardware configuration may comprise a processing system in a wireless node. The processing system may be implemented with a bus architecture. The bus may include any number of interconnecting buses and bridges depending on the specific application of the processing system and the overall design constraints. The bus may link together various circuits including a processor, machine-readable media, and a bus interface. The bus interface may be used to connect a network adapter, among other things, to the processing system via the bus. The network adapter may be used to implement the signal processing functions of the physical (PHY) layer. In the case of a user terminal, a user interface (e.g., keypad, display, mouse, joystick, etc.) may also be connected to the bus. The bus may also link various other circuits such as timing sources, peripherals, voltage regulators, power management circuits, and the like, which are well known in the art, and therefore, will not be described any further.

The processing system may be configured as a general-purpose processing system with one or more microprocessors providing the processor functionality and external memory providing at least a portion of the machine-readable media, all linked together with other supporting circuitry through an external bus architecture. Alternatively, the processing system may be implemented with an ASIC with the processor, the bus interface, the user interface in the case of an access terminal), supporting circuitry, and at least a portion of the machine-readable media integrated into a single chip, or with one or more FPGAs, PLDs, controllers, state machines, gated logic, discrete hardware components, or any other suitable circuitry, or any combination of circuits that can perform the various functionality described throughout this disclosure. Those skilled in the art will recognize how best to implement the described functionality for the processing system depending on the particular application and the overall design constraints imposed on the overall system.

Example Aspects

In addition to the various aspects described above, specific combinations of aspects are within the scope of the disclosure, some of which are detailed below:

Aspect 1: A power supply system, comprising: a first voltage regulator; a second voltage regulator, outputs of the first voltage regulator and the second voltage regulator being coupled to an output of the power supply system; and a current balancer circuit configured to adjust an output current of the first voltage regulator based on determined headrooms of the first voltage regulator and the second voltage regulator.

Aspect 2: The power supply system of Aspect 1, wherein: the first voltage regulator comprises a first transistor, the determined headroom of the first voltage regulator being a difference between a drain voltage and a source voltage of the first transistor; and the second voltage regulator comprises a second transistor, the determined headroom of the second voltage regulator being a difference between a drain voltage and a source voltage of the second transistor.

Aspect 3: The power supply system of Aspect 1 or 2, wherein the current balancer circuit is configured to adjust the output current of the first voltage regulator based on whether the determined headroom of the first voltage regulator is within a first headroom range and whether the determined headroom of the second voltage regulator is within a second headroom range.

Aspect 4: The power supply system of Aspect 3, wherein: the first headroom range comprises an acceptable headroom for the first voltage regulator given the output current of the first voltage regulator; and the second headroom range comprises an acceptable headroom for the second voltage regulator given an output current of the second voltage regulator.

Aspect 5: The power supply system of Aspect 3 or 4, wherein: an upper limit of the first headroom range or the second headroom range is less than a lower limit of a third headroom range associated with the first voltage regulator or the second voltage regulator operating in saturation, respectively; and a lower limit of the first headroom range or the second headroom range is greater than an upper limit of a fourth headroom range associated with the first voltage regulator or the second voltage regulator operating in triode, respectively.

Aspect 6: The power supply system of any of Aspects 3-5, wherein the current balancer circuit is configured to decrease the output current of the first voltage regulator based on the determined headroom of the second voltage regulator being higher than an upper limit of the second headroom range and the determined headroom of the first voltage regulator being lower than a lower limit of the first headroom range.

Aspect 7: The power supply system of any of Aspects 3-6, wherein the current balancer circuit is configured to increase the output current of the first voltage regulator based on the determined headroom of the first voltage regulator being higher than an upper limit of the first headroom range and the determined headroom of the second voltage regulator being lower than a lower limit of the second headroom range.

Aspect 8: The power supply system of any preceding Aspect, further comprising a headroom adjustment circuit configured to adjust a headroom of the first voltage regulator and a headroom of the second voltage regulator based on at least one of the determined headrooms of the first voltage regulator and the second voltage regulator.

Aspect 9: The power supply system of Aspect 8, wherein the headroom adjustment circuit is configured to increase the headrooms of the first voltage regulator and the second voltage regulator based on the determined headroom of at least one of the first voltage regulator or the second voltage regulator being lower than a headroom range.

Aspect 10: The power supply system of Aspect 8 or 9, wherein the headroom adjustment circuit is configured to decrease the headrooms of the first voltage regulator and the second voltage regulator based on the determined headrooms of the first voltage regulator and the second voltage regulator being higher than a headroom range.

Aspect 11: The power supply system of any of Aspects 1-7, further comprising: a headroom adjustment circuit configured to adjust headrooms of the first voltage regulator and the second voltage regulator; and an auto headroom control circuit configured to: receive indications of the determined headrooms of the first voltage regulator and the second voltage regulator; and control the headroom adjustment circuit and the current balancer circuit based on the indications of the determined headrooms.

Aspect 12: The power supply system of Aspect 11, wherein the headroom adjustment circuit comprises a power supply configured to generate an input voltage for the first voltage regulator and the second voltage regulator.

Aspect 13: The power supply system of any preceding Aspect, wherein the current balancer circuit is configured to adjust an offset between a first reference voltage for the first voltage regulator and a second reference voltage for the second voltage regulator.

Aspect 14: The power supply system of Aspect 13, wherein: the first voltage regulator comprises a first amplifier having a first input configured to receive the first reference voltage and a second input coupled to the output of the first voltage regulator; and the second voltage regulator comprises a second amplifier having a first input configured to receive the second reference voltage and a second input coupled to the output of the second voltage regulator.

Aspect 15: The power supply system of Aspect 14, wherein the current balancer circuit comprises an adjustable voltage source coupled between a reference voltage node and the first input of the first amplifier, the current balancer circuit being configured to adjust the offset by controlling the adjustable voltage source.

Aspect 16: The power supply system of any preceding Aspect, further comprising: a first resistive element coupled between the output of the first voltage regulator and the output of the power supply system and having a first resistance; and a second resistive element coupled between the output of the second voltage regulator and the output of the power supply system and having a second resistance, different from the first resistance of the first resistive element.

Aspect 17: The power supply system of any preceding Aspect, wherein the first voltage regulator and the second voltage regulator comprise low-dropout (LDO) regulators.

Aspect 18: A method of supplying power, comprising: generating a first output current via a first voltage regulator; generating a second output current via a second voltage regulator, the first output current and the second output current being sourced to a common output node; and adjusting, via a current balancer circuit, the first output current based on determined headrooms of the first voltage regulator and the second voltage regulator.

Aspect 19: The method of Aspect 18, wherein: the first voltage regulator comprises a first transistor; the method further comprises determining the headroom of the first voltage regulator by determining a difference between a drain voltage and a source voltage of the first transistor; the second voltage regulator comprises a second transistor; and the method further comprises determining the headroom of the second voltage regulator by determining a difference between a drain voltage and a source voltage of the second transistor.

Aspect 20: The method of Aspect 18 or 19, wherein the adjusting of the first output current is based on whether the determined headroom of the first voltage regulator is within a first headroom range and whether the determined headroom of the second voltage regulator is within a second headroom range.

Aspect 21: The method of Aspect 20, wherein: an upper limit of the first headroom range or the second headroom range is less than a lower limit of a third headroom range associated with the first voltage regulator or the second voltage regulator operating in saturation, respectively; and a lower limit of the first headroom range or the second headroom range is greater than an upper limit of a fourth headroom range associated with the first voltage regulator or the second voltage regulator operating in triode, respectively.

Aspect 22: The method of Aspect 20, wherein adjusting the first output current comprises decreasing the first output current based on the determined headroom of the second voltage regulator being higher than an upper limit of the second headroom range and the determined headroom of the first voltage regulator being lower than a lower limit of the first headroom range.

Aspect 23: The method of Aspect 20, wherein adjusting the first output current comprises increasing the first output current based on the determined headroom of the first voltage regulator being higher than an upper limit of the first headroom range and the determined headroom of the second voltage regulator being lower than a lower limit of the second headroom range.

Aspect 24: The method of any of Aspects 18-23, further comprising adjusting, via a headroom adjustment circuit, a headroom of the first voltage regulator and a headroom of the second voltage regulator based on at least one of the determined headrooms of the first voltage regulator and the second voltage regulator.

Aspect 25: The method of Aspect 24, wherein adjusting the headrooms comprises increasing the headrooms of the first voltage regulator and the second voltage regulator based on the determined headroom of at least one of the first voltage regulator or the second voltage regulator being lower than a headroom range.

Aspect 26: The method of Aspect 24, wherein adjusting the headrooms comprises decreasing the headrooms of the first voltage regulator and the second voltage regulator based on the determined headrooms of the first voltage regulator and the second voltage regulator being higher than a headroom range.

Aspect 27: The method of any of Aspects 18-23, further comprising: adjusting, via a headroom adjustment circuit, headrooms of the first voltage regulator and the second voltage regulator; receiving, via an auto headroom control circuit, indications of the determined headrooms of the first voltage regulator and the second voltage regulator; and controlling, via the auto headroom control circuit, the headroom adjustment circuit and the current balancer circuit based on the indications of the determined headrooms.

Aspect 28: The method of Aspect 24 or 27, wherein the headroom adjustment circuit comprises a power supply configured to generate an input voltage for the first voltage regulator and the second voltage regulator.

Aspect 29: The method of any of Aspects 18-28, wherein adjusting the first output current comprises adjusting an offset between a first reference voltage for the first voltage regulator and a second reference voltage for the second voltage regulator.

Aspect 30: An apparatus for supplying power, comprising: means for generating a first output current; means for generating a second output current, the first output current and the second output current being sourced to a common output node; and means for adjusting the first output current based on determined headrooms associated with the means for generating the first output current and the means for generating the second output current.

It is to be understood that the claims are not limited to the precise configuration and components illustrated above. Various modifications, changes, and variations may be made in the arrangement, operation, and details of the methods and apparatus described above without departing from the scope of the claims.

What is claimed is:

1. A power supply system, comprising:

a first voltage regulator;

a second voltage regulator, outputs of the first voltage regulator and the second voltage regulator being coupled to an output of the power supply system; and a current balancer circuit configured to adjust an output current of the first voltage regulator based on determined headrooms of the first voltage regulator and the second voltage regulator, wherein:

the current balancer circuit is configured to adjust the output current of the first voltage regulator based on whether the determined headroom of the first voltage regulator is within a first headroom range and whether the determined headroom of the second voltage regulator is within a second headroom range; and an upper limit of the first headroom range or the second headroom range is less than a lower limit of a third headroom range associated with the first voltage regulator or the second voltage regulator operating in saturation, respectively.

2. The power supply system of claim 1, wherein:

the first voltage regulator comprises a first transistor, the determined headroom of the first voltage regulator being a difference between a drain voltage and a source voltage of the first transistor; and the second voltage regulator comprises a second transistor, the determined headroom of the second voltage regulator being a difference between a drain voltage and a source voltage of the second transistor.

3. The power supply system of claim 1, wherein:

the first headroom range comprises an acceptable headroom for the first voltage regulator given the output current of the first voltage regulator; and the second headroom range comprises an acceptable headroom for the second voltage regulator given an output current of the second voltage regulator.

4. The power supply system of claim 1, wherein a lower limit of the first headroom range or the second headroom range is greater than an upper limit of a fourth headroom range associated with the first voltage regulator or the second voltage regulator operating in triode, respectively.

5. The power supply system of claim 1, wherein the current balancer circuit is configured to decrease the output current of the first voltage regulator based on the determined headroom of the second voltage regulator being higher than the upper limit of the second headroom range and the determined headroom of the first voltage regulator being lower than a lower limit of the first headroom range.

6. The power supply system of claim 1, wherein the current balancer circuit is configured to increase the output current of the first voltage regulator based on the determined headroom of the first voltage regulator being higher than the upper limit of the first headroom range and the determined headroom of the second voltage regulator being lower than a lower limit of the second headroom range.

7. The power supply system of claim 1, further comprising a headroom adjustment circuit configured to adjust a headroom of the first voltage regulator and a headroom of the second voltage regulator based on at least one of the determined headrooms of the first voltage regulator and the second voltage regulator.

8. The power supply system of claim 7, wherein the headroom adjustment circuit is configured to increase the headrooms of the first voltage regulator and the second voltage regulator based on the determined headroom of at least one of the first voltage regulator or the second voltage regulator being lower than a headroom range.

9. The power supply system of claim 7, wherein the headroom adjustment circuit is configured to decrease the headrooms of the first voltage regulator and the second voltage regulator based on the determined headrooms of the first voltage regulator and the second voltage regulator being higher than a headroom range.

10. A method of supplying power, comprising:

generating a first output current via a first voltage regulator;

generating a second output current via a second voltage regulator, the first output current and the second output current being sourced to a common output node; and adjusting, via a current balancer circuit, the first output current based on determined headrooms of the first voltage regulator and the second voltage regulator, wherein:

the adjusting of the first output current is based on whether the determined headroom of the first voltage regulator is within a first headroom range and whether the determined headroom of the second voltage regulator is within a second headroom range; and an upper limit of the first headroom range or the second headroom range is less than a lower limit of a third headroom range associated with the first voltage regulator or the second voltage regulator operating in saturation, respectively.

11. The power supply system of claim 1, further comprising:

a headroom adjustment circuit configured to adjust headrooms of the first voltage regulator and the second voltage regulator; and an auto headroom control circuit configured to:

receive indications of the determined headrooms of the first voltage regulator and the second voltage regulator; and control the headroom adjustment circuit and the current balancer circuit based on the indications of the determined headrooms.

12. The power supply system of claim 11, wherein the headroom adjustment circuit comprises a power supply configured to generate an input voltage for the first voltage regulator and the second voltage regulator.

13. The power supply system of claim 1, wherein the current balancer circuit is configured to adjust an offset between a first reference voltage for the first voltage regulator and a second reference voltage for the second voltage regulator.

14. The power supply system of claim 13, wherein:

the first voltage regulator comprises a first amplifier having a first input configured to receive the first reference voltage and having a second input coupled to the output of the first voltage regulator; and the second voltage regulator comprises a second amplifier having a first input configured to receive the second reference voltage and having a second input coupled to the output of the second voltage regulator.

15. The power supply system of claim 14, wherein the current balancer circuit comprises an adjustable voltage source coupled between a reference voltage node and the first input of the first amplifier, the current balancer circuit being configured to adjust the offset by controlling the adjustable voltage source.

16. The power supply system of claim 1, further comprising:

a first resistive element coupled between the output of the first voltage regulator and the output of the power supply system and having a first resistance; and a second resistive element coupled between the output of the second voltage regulator and the output of the power supply system and having a second resistance, different from the first resistance of the first resistive element.

17. The power supply system of claim 1, wherein the first voltage regulator and the second voltage regulator comprise low-dropout (LDO) regulators.

18. The method of claim 10, wherein a lower limit of the first headroom range or the second headroom range is greater than an upper limit of a fourth headroom range associated with the first voltage regulator or the second voltage regulator operating in triode, respectively.

19. The method of claim 10, wherein:

the first voltage regulator comprises a first transistor;

the method further comprises determining the headroom of the first voltage regulator by determining a difference between a drain voltage and a source voltage of the first transistor;

the second voltage regulator comprises a second transistor; and the method further comprises determining the headroom of the second voltage regulator by determining a difference between a drain voltage and a source voltage of the second transistor.

20. The method of claim 10, wherein adjusting the first output current comprises decreasing the first output current based on the determined headroom of the second voltage regulator being higher than the upper limit of the second headroom range and the determined headroom of the first voltage regulator being lower than a lower limit of the first headroom range.

21. The method of claim 10, wherein adjusting the first output current comprises increasing the first output current based on the determined headroom of the first voltage regulator being higher than the upper limit of the first headroom range and the determined headroom of the second voltage regulator being lower than a lower limit of the second headroom range.

22. The method of claim 10, further comprising adjusting, via a headroom adjustment circuit, a headroom of the first voltage regulator and a headroom of the second voltage regulator based on at least one of the determined headrooms of the first voltage regulator and the second voltage regulator.

23. The method of claim 22, wherein adjusting the headrooms comprises increasing the headrooms of the first voltage regulator and the second voltage regulator based on the determined headroom of at least one of the first voltage regulator or the second voltage regulator being lower than a headroom range.

24. The method of claim 22, wherein adjusting the headrooms comprises decreasing the headrooms of the first voltage regulator and the second voltage regulator based on the determined headrooms of the first voltage regulator and the second voltage regulator being higher than a headroom range.

25. The method of claim 10, further comprising:

adjusting, via a headroom adjustment circuit, headrooms of the first voltage regulator and the second voltage regulator;

receiving, via an auto headroom control circuit, indications of the determined headrooms of the first voltage regulator and the second voltage regulator; and controlling, via the auto headroom control circuit, the headroom adjustment circuit and the current balancer circuit based on the indications of the determined headrooms.

26. The method of claim 25, wherein the headroom adjustment circuit comprises a power supply configured to generate an input voltage for the first voltage regulator and the second voltage regulator.

27. The method of claim 10, wherein adjusting the first output current comprises adjusting an offset between a first reference voltage for the first voltage regulator and a second reference voltage for the second voltage regulator.

28. An apparatus for supplying power, comprising:

means for generating a first output current;

means for generating a second output current, the first output current and the second output current being sourced to a common output node; and means for adjusting the first output current based on determined headrooms associated with the means for generating the first output current and the means for generating the second output current, wherein:

the means for adjusting the first output current is configured to adjust the first output current based on whether the determined headroom of the means for generating the first output current is within a first headroom range and whether the determined headroom of the means for generating the second output current is within a second headroom range; and a lower limit of the first headroom range or the second headroom range is greater than an upper limit of a third headroom range associated with the means for generating the first output current or the means for generating the second output current operating in triode, respectively.

29. The apparatus of claim 28, wherein an upper limit of the first headroom range or the second headroom range is less than a lower limit of a fourth headroom range associated with the means for generating the first output current or the means for generating the second output current operating in saturation, respectively.

30. A power supply system, comprising:

a first voltage regulator;

a second voltage regulator, outputs of the first voltage regulator and the second voltage regulator being coupled to an output of the power supply system; and a current balancer circuit configured to adjust an output current of the first voltage regulator based on determined headrooms of the first voltage regulator and the second voltage regulator, wherein:

the current balancer circuit is configured to adjust the output current of the first voltage regulator based on whether the determined headroom of the first voltage regulator is within a first headroom range and whether the determined headroom of the second voltage regulator is within a second headroom range; and a lower limit of the first headroom range or the second headroom range is greater than an upper limit of a third headroom range associated with the first voltage regulator or the second voltage regulator operating in saturation, respectively.

* * * * *